US009540205B2

(12) United States Patent
Okamura

(10) Patent No.: US 9,540,205 B2
(45) Date of Patent: Jan. 10, 2017

(54) SHEET SORTING APPARATUS

(71) Applicant: KYOCERA Document Solutions Inc., Osaka (JP)

(72) Inventor: Hideki Okamura, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 115 days.

(21) Appl. No.: 14/620,452

(22) Filed: Feb. 12, 2015

(65) Prior Publication Data

US 2015/0239703 A1 Aug. 27, 2015

(30) Foreign Application Priority Data

Feb. 27, 2014 (JP) ..... 2014-037573
Feb. 27, 2014 (JP) ..... 2014-037575
Feb. 27, 2014 (JP) ..... 2014-037576

(51) Int. Cl.
*B65H 33/06* (2006.01)
*B65H 29/52* (2006.01)
(Continued)

(52) U.S. Cl.
CPC ..... *B65H 29/52* (2013.01); *B42C 1/12* (2013.01); *B65H 9/06* (2013.01); *B65H 9/10* (2013.01); *B65H 31/04* (2013.01); *B65H 31/3081* (2013.01); *B65H 33/06* (2013.01); *B65H 33/08* (2013.01); *B65H 39/10* (2013.01); *B65H 2220/09* (2013.01); *B65H 2301/4212* (2013.01); *B65H 2301/4213* (2013.01); *B65H 2301/4219* (2013.01); *B65H 2301/42194* (2013.01); *B65H 2403/512* (2013.01); *B65H 2404/73* (2013.01);
(Continued)

(58) Field of Classification Search
CPC ... B42C 1/12; G03G 2215/0089; B65H 33/06; B65H 31/04; B65H 9/06; B65H 9/10
USPC ..... 270/58.02, 58.07, 58.11, 58.12, 58.17,270/58.27; 271/213, 214
See application file for complete search history.

(56) References Cited

U.S. PATENT DOCUMENTS 5,215,300 A * 6/1993 Hiroi et al. ..... 271/176
5,344,130 A * 9/1994 Suzuki et al. ..... 270/58.02
(Continued)

FOREIGN PATENT DOCUMENTS

JP 58-48652 4/1983
JP 62-46863 2/1987
(Continued)

*Primary Examiner* — Leslie A Nicholson, III
(74) *Attorney, Agent, or Firm* — Wenderoth, Lind & Ponack, L.L.P.

(57) ABSTRACT

A sheet sorting apparatus includes a discharge port through which sheets are discharged, a stacking tray on which the sheets discharged from the discharge port are stacked, a sheet sorting member provided on a stacking surface on which the sheets of the stacking tray are stacked, and an operation mechanism for operating the sheet sorting member. The sheet sorting member is provided to be able to rise from the stacking surface by employing one end of the sheet sorting member as a pivot point, at a position at which the sheets fall from the discharge port. The sheet sorting member rises from the stacking surface by the operation mechanism, thereby forming an inclined surface, guiding the sheets placed on the inclined surface along the inclined surface, and shifting the sheets stacked on the stacking tray to a discharge direction of the sheets and a direction perpendicular to the discharge direction.

13 Claims, 13 Drawing Sheets

(51) Int. Cl.

| | |
|---|---|
| ***B42C 1/12*** | (2006.01) |
| ***B65H 9/10*** | (2006.01) |
| ***B65H 31/04*** | (2006.01) |
| ***B65H 9/06*** | (2006.01) |
| ***B65H 31/30*** | (2006.01) |
| ***B65H 33/08*** | (2006.01) |
| ***B65H 39/10*** | (2006.01) |

(52) U.S. Cl.
CPC ..... *B65H 2404/74* (2013.01); *B65H 2405/114* (2013.01); *B65H 2405/1134* (2013.01); *B65H 2511/20* (2013.01); *B65H 2511/415* (2013.01); *B65H 2801/06* (2013.01); *B65H 2801/27* (2013.01); *G03G 2215/0089* (2013.01)

(56) References Cited

U.S. PATENT DOCUMENTS

| | | | | |
|---|---|---|---|---|
| 5,497,984 | A * | 3/1996 | Murakami et al. | 270/58.02 |
| 5,737,987 | A * | 4/1998 | Olson et al. | 83/89 |
| 6,260,843 | B1 * | 7/2001 | Hoshimura et al. | 271/213 |
| 7,207,559 | B2 * | 4/2007 | Mizuta et al. | 271/207 |
| 7,793,925 | B2 * | 9/2010 | Tokuno | 270/58.09 |
| 7,922,164 | B2 * | 4/2011 | Nakayama | 270/58.12 |
| 8,167,294 | B2 * | 5/2012 | Yahata | 270/58.27 |
| 8,672,313 | B2 * | 3/2014 | Fukami | 270/58.09 |
| 8,678,368 | B2 * | 3/2014 | Yoshida | 270/58.13 |
| 8,770,570 | B2 * | 7/2014 | Soga | 270/58.12 |
| 8,844,927 | B2 * | 9/2014 | Hazu et al. | 271/220 |
| 8,967,610 | B2 * | 3/2015 | Takashima | 270/58.07 |
| 2011/0233853 | A1 * | 9/2011 | Naraoka | 271/213 |

FOREIGN PATENT DOCUMENTS

| | | |
|---|---|---|
| JP | 62-185677 | 8/1987 |
| JP | 2003-146528 | 5/2003 |

* cited by examiner

SHEET SORTING APPARATUS

CROSS-REFERENCE TO RELATED APPLICATION

This application is based upon and claims the benefit of priority from Japanese Patent Application No. 2014-037573 filed on Feb. 27, 2014, No. 2014-037575 filed on Feb. 27, 2014, and No. 2014-037576 filed on Feb. 27, 2014, the entire contents of which are incorporated herein by reference.

BACKGROUND

The technology of the present disclosure relates to a sheet sorting apparatus, and more particularly, to a technology for sorting sheets stacked on a stacking tray.

In an image forming apparatus such as a printer and a copy machine which is an example of a sheet sorting apparatus, an image is formed on sheets, and then the sheets with the formed image are discharged from a discharge port. A stacking tray is provided below the discharge port, and the sheets discharged from the discharge port are stacked on the stacking tray. In relation to this, there has been known a technology in which the stacking tray is moved in a direction perpendicular to the discharge direction of the sheets to shift the position of the sheets on the stacking tray to the direction perpendicular to the discharge direction of the sheets, so that the sheets are sorted.

SUMMARY

A sheet sorting apparatus according to one aspect of the present disclosure includes a discharge port, a stacking tray, a sheet sorting member, and an operation mechanism. Sheets are discharged from the discharge port. On the stacking tray, the sheets discharged from the discharge port are stacked. The sheet sorting member is provided on a stacking surface on which the sheets of the stacking tray are stacked. The operation mechanism operates the sheet sorting member.

The sheet sorting member is provided to be able to rise from the stacking surface by employing one end of the sheet sorting member as a pivot point, at a position at which the sheets fall from the discharge port. The sheet sorting member rises from the stacking surface by the operation mechanism, thereby forming an inclined surface, guiding the sheets placed on the inclined surface along the inclined surface, and shifting the sheets stacked on the stacking tray in a discharge direction of the sheets and a direction perpendicular to the discharge direction.

DETAILED DESCRIPTION

Embodiment 1

Figure 1:
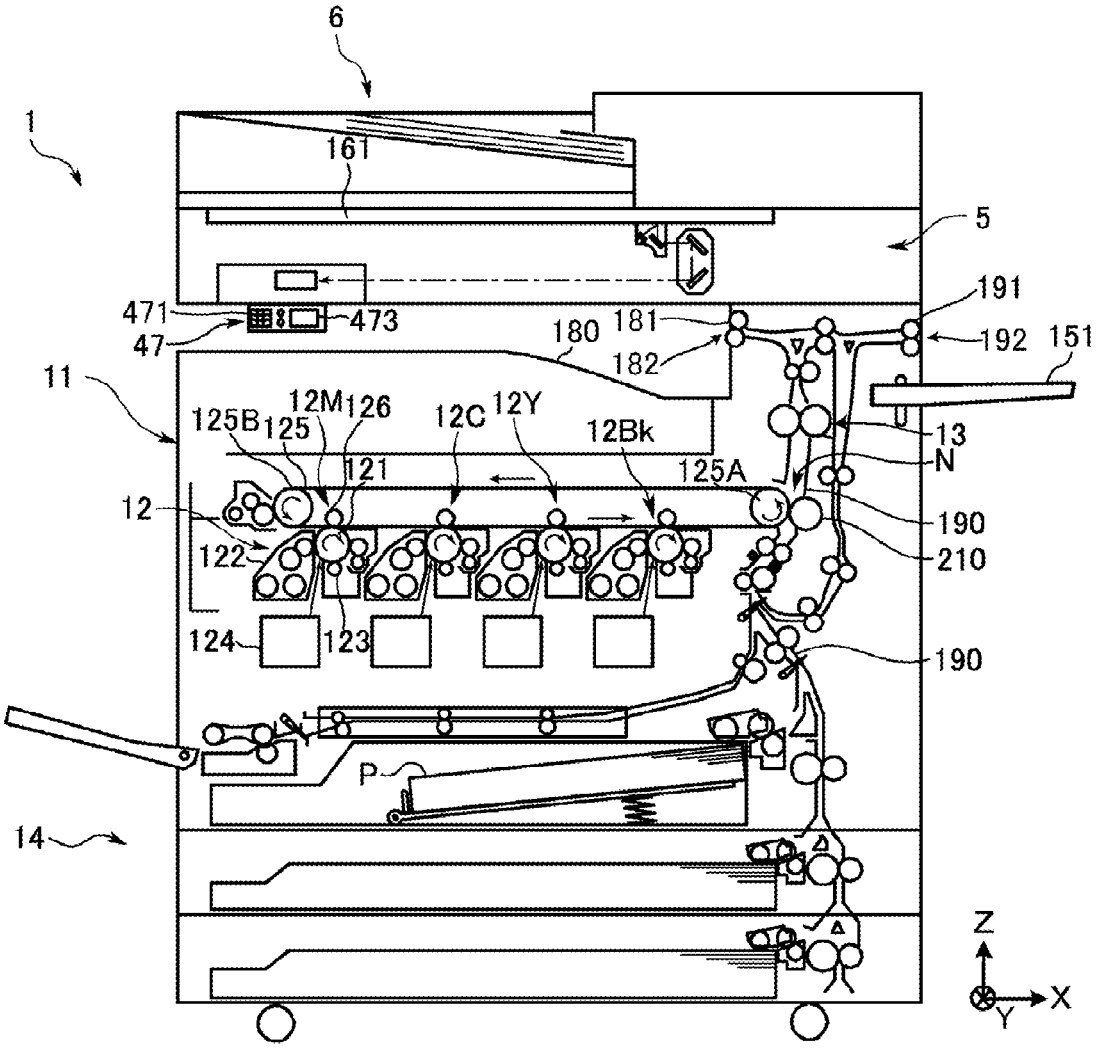
FIG. 1 is a front sectional view illustrating the structure of an image forming apparatus which is an example of a sheet sorting apparatus according to an embodiment.

Hereinafter, a sheet sorting apparatus according to embodiments will now be described with reference to the accompanying drawings. FIG. 1 is a front sectional view illustrating the structure of an image forming apparatus which is an example of a sheet sorting apparatus according to an embodiment.

An image forming apparatus 1 according to an embodiment, for example, indicates a multifunctional peripheral having a plurality of functions such as a copy function, a printer function, a scanner function, and a facsimile function. The image forming apparatus 1 is configured to include an apparatus body 11 provided with an image forming unit 12, a fixing unit 13, a sheet feeding unit 14, an image reading unit 5, a document feeding unit 6, an operating unit 47 and the like.

When the image forming apparatus 1 performs an image reading operation, the image reading unit 5 optically reads an image of a document fed by the document feeding unit 6, or a document placed on a contact glass (a document platen glass) 161, and generates image data. The image data generated by the image reading unit 5 is stored in an embedded HDD, a network-connected computer, and the like.

When the image forming apparatus 1 performs an image forming operation, the image forming unit 12 forms a toner image on a sheet P as a recording medium fed from the sheet feeding unit 14, on the basis of the image data generated by the aforementioned image reading operation, image data received from the network-connected computer or a user terminal device such as a smart phone, image data stored in the embedded HDD, and the like. Image forming units 12M, 12C, 12Y, and 12Bk of the image forming unit 12 are respectively provided with a photosensitive drum 121, a developing device 122 for supplying a toner to the photosensitive drum 121, a toner cartridge (not illustrated) for storing the toner, a charging device 123, an exposure device 124, and a primary transfer roller 126.

In the case of performing color printing, each of the image forming unit 12M for magenta, the image forming unit 12C for cyan, the image forming unit 12Y for yellow, and the image forming unit 12Bk for black of the image forming unit 12 forms a toner image on the photosensitive drum 121 through charging, exposure, and development processes on the basis of an image including respective color components constituting image data, and transfers the toner image onto an intermediate transfer belt 125 stretched between a driving roller 125A and a driven roller 125B by the primary transfer roller 126.

The intermediate transfer belt 125 is provided an outer peripheral surface thereof with an image carrying surface to which the toner image is transferred, and is driven by the driving roller 125A in the state in which the intermediate transfer belt 125 has been brought into contact with a peripheral surface of the photosensitive drum 121. The intermediate transfer belt 125 endlessly travels between the driving roller 125A and the driven roller 125B while synchronizing with each photosensitive drum 121.

The toner images of each color transferred onto the intermediate transfer belt 125 are superposed on the intermediate transfer belt 125 by adjusting a transfer timing, and become a color toner image. A secondary transfer roller 210 transfers the color toner image formed on the surface of the intermediate transfer belt 125 to a sheet P, which has been conveyed from the sheet feeding unit 14 through a conveyance path 190, at a nip portion N with the driving roller 125A while interposing the intermediate transfer belt 125 between the driving roller 125A and the secondary transfer roller 210. Thereafter, the toner image on the sheet P is fixed to the sheet P through thermal compression by the fixing unit 13.

The sheet P with the color image subjected to the fixing process is discharged from a discharge port 192 by a discharge roller 191. A stacking tray 151 is provided below the discharge port 192, and the sheet P discharged from the discharge port 192 is stacked on the stacking tray 151.

The stacking tray 151 is provided with a plurality of sheet sorting members 160 (referring to FIG. 2) provided on a stacking surface on which the sheet P is stacked, and an operation mechanism 170 (referring to FIG. 3) for operating the sheet sorting members 160, which will be described in detail later. The sheet sorting members 160 are operated by the operation mechanism 170, so that the position of the sheet P on the stacking tray 151 is shifted in the discharge direction of the sheet P and a direction perpendicular to the discharge direction.

The operating unit 47 is provided with a plurality of instruction keys 471 and a display part 473. The display part 473 includes a liquid crystal display or an organic EL display, and displays a menu screen and the like drawn by an accepting section 102 of a control unit 10 to be described later.

The instruction keys 471, for example, include a menu key for calling a menu, an arrow key for moving the focus of GUI constituting the menu, a decision key for performing a deciding operation for the GUI constituting the menu, a character input key for performing character input, a numerical input key for performing numerical input, and the like, and accepts an operation for the menu displayed on the display part 473 from a user.

Figure 2:
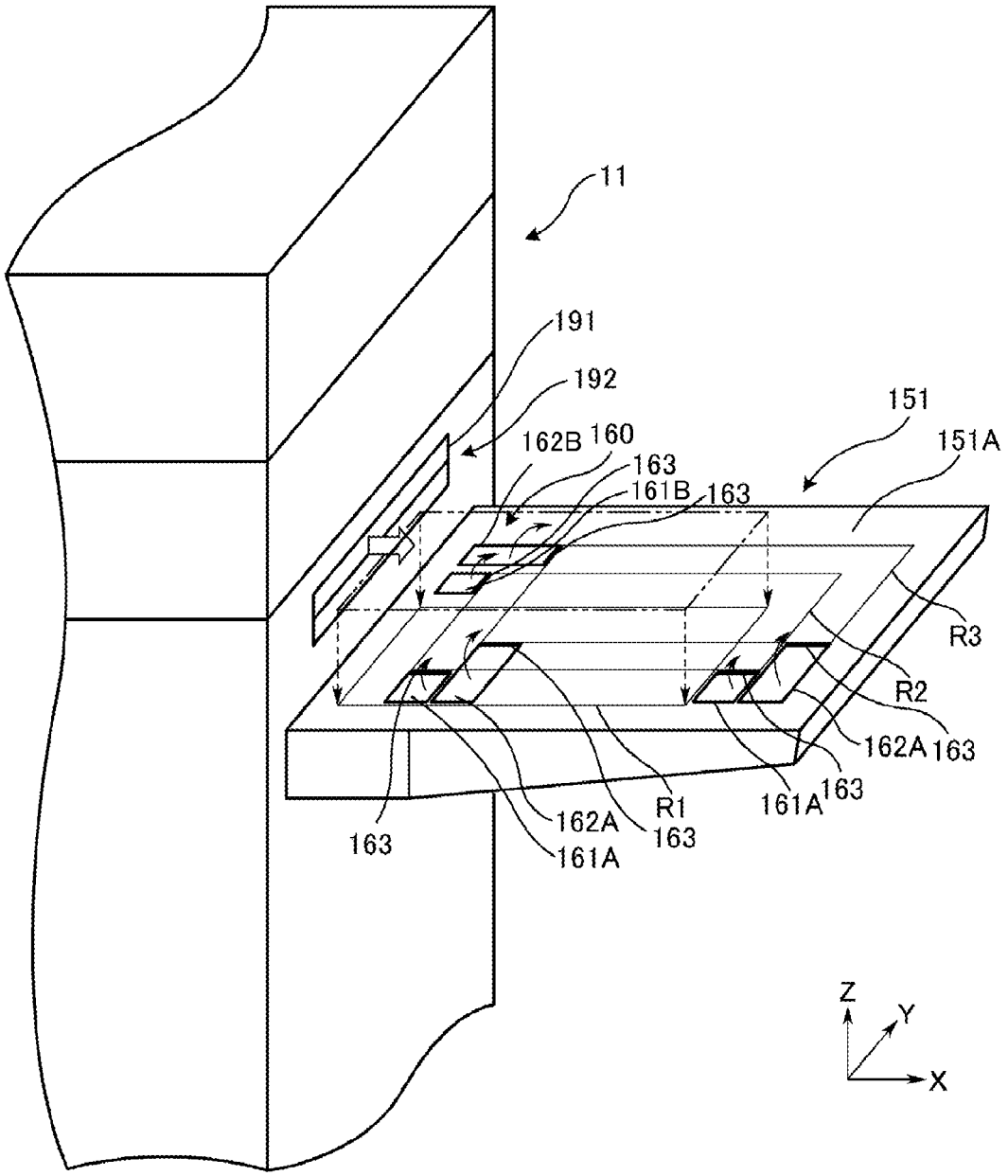
FIG. 2 is a perspective view illustrating a stacking tray and a sheet sorting member according to an embodiment.

FIG. 2 is a perspective view illustrating the stacking tray 151 and the sheet sorting member 160. As illustrated in FIG. 2, on the stacking surface 151A of the stacking tray 151, the plurality of sheet sorting members 160 are provided at positions at which sheets P fall from the discharge port 192. Each sheet sorting member 160 has an approximately flat plate shape, and can rise from the stacking surface 151A by employing one end of each sheet sorting member 160 as a pivot point 163 as indicated by arrows of the drawing. Each sheet sorting member 160 rises from the stacking surface 151A by the operation mechanism 170 (referring to FIG. 3) to be described later, forms an inclined surface, and guides the sheets P placed on the inclined surface along the inclined surface, thereby shifting the sheets P stacked on the stacking tray 151 in the discharge direction of the sheets P (an X direction of the drawing) and a direction perpendicular to the discharge direction (a Y direction of the drawing).

The sheet sorting members 160 include a plurality of sheet sorting members having lengths different from one another from one end as the aforementioned pivot point 163 to the other end. In detail, as illustrated in FIG. 2, the sheet sorting member 160 has first sheet sorting members 161A and 161B and second sheet sorting members 162A and 162B. The second sheet sorting members 162A and 162B have long lengths from one end as the aforementioned pivot point 163 to the other end, as compared with the first sheet sorting members 161A and 161B. In addition, in FIG. 2, the other ends of the first sheet sorting members 161A and 161B and the second sheet sorting members 162A and 162B are positioned on the outer periphery of an area in which the sheets P on the stacking tray 151 are stacked. However, the technology of the present disclosure is not necessarily limited to this case. The other ends of the first sheet sorting members 161A and 161B and the second sheet sorting members 162A and 162B may also be positioned outward from the outer periphery of the area in which the sheets P on the stacking tray 151 are stacked. In this way, it is possible to more accurately shift the sheets P in the discharge direction of the sheets P and the direction perpendicular to the discharge direction.

Two first sheet sorting members 161A and two second sheet sorting members 162A are respectively provided at end portions of the direction perpendicular to the discharge direction of the sheets P (the Y direction of the drawing) on the stacking surface 151A of the stacking tray 151. Furthermore, the first sheet sorting member 161A and the second sheet sorting member 162A can rise in the direction perpendicular to the discharge direction of the sheets P. Furthermore, one first sheet sorting member 161B and one second sheet sorting member 162B are respectively provided at end portions of the discharge direction of the sheets P (the X direction of the drawing) on the stacking surface 151A of the stacking tray 151. Furthermore, the first sheet sorting member 161B and the second sheet sorting member 162B can rise in the discharge direction of the sheets P (the X direction of the drawing).

Figure 3:
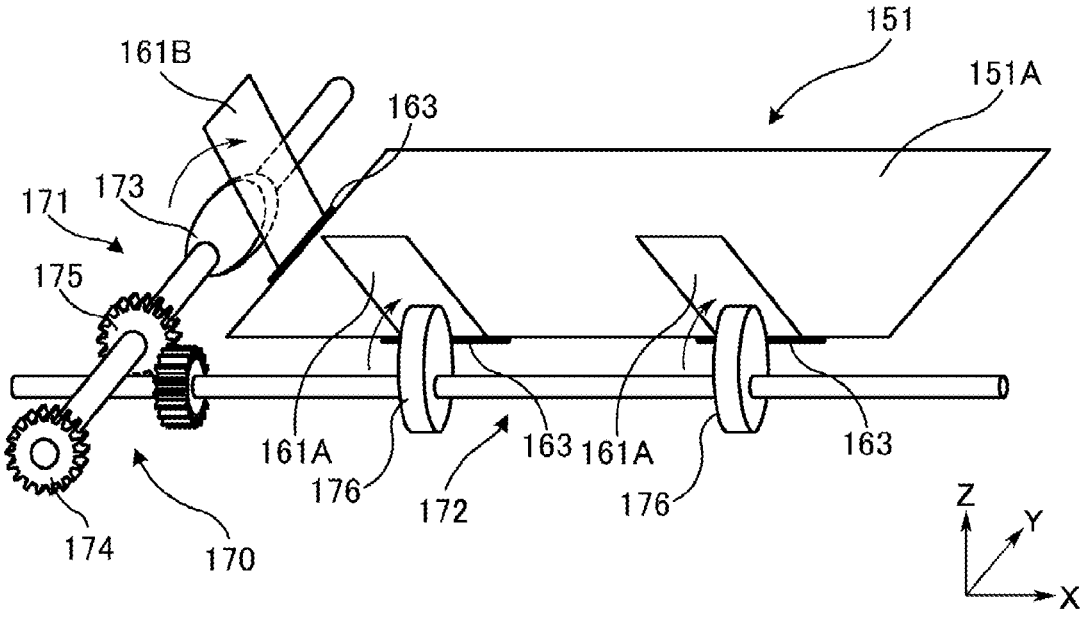
FIG. 3 is a schematic view illustrating the structure of an operation mechanism for operating a sheet sorting member according to an embodiment.

FIG. 3 is a schematic view illustrating the structure of the operation mechanism 170 for operating the sheet sorting member 160. As illustrated in FIG. 3, the stacking tray 151 is provided therein with the operation mechanism 170 for operating the sheet sorting member 160. The operation mechanism 170 has a first cam shaft 171 extending in the direction perpendicular to the discharge direction of the sheets P (the Y direction of the drawing), and a second cam shaft 172 extending in the discharge direction of the sheets P (the X direction of the drawing). The first cam shaft 171 receives a driving force supplied from a motor (not illustrated) via a driving force supply gear 174. Below the first sheet sorting member 161B, an eccentric cam 173 of the first cam shaft 171 is provided. The eccentric cam 173 is rotated by the driving force supplied to the first cam shaft 171, so that a force acts in a vertical direction with respect to the first sheet sorting member 161B. In this way, the first sheet sorting member 161B swings around the pivot point 163 when a rising operation from the stacking surface 151A of the stacking tray 151 and an operation of returning from the rising state are repeated. In the state in which the first sheet sorting member 161B has risen from the stacking surface 151A, since an inclined surface is formed, the sheets P stacked on the inclined surface are guided along the inclined surface. As a consequence, the sheets P discharged from the discharge port 192 and having edge portions falling at the position of the other end of the first sheet sorting member 161B are shifted to a position at which the pivot point 163 of the first sheet sorting member 161B has been provided.

The first cam shaft 171 is provided with a driving force distribution gear 175 for distributing the driving force supplied from the motor (not illustrated) via the driving force supply gear 174 to the second cam shaft 172. The driving force supplied from the motor (not illustrated) is distributed to the second cam shaft 172 by the driving force distribution gear 175. Below the first sheet sorting member 161A, an eccentric cam 176 of the second cam shaft 172 is provided. The eccentric cam 176 is rotated by the driving force distributed to the second cam shaft 172, so that a force acts in a vertical direction with respect to the first sheet sorting member 161A. In this way, the first sheet sorting member 161A swings around the pivot point 163 when a rising operation from the stacking surface 151A of the stacking tray 151 and an operation of returning from the rising state are repeated. In the state in which the first sheet sorting member 161A has risen from the stacking surface 151A, since an inclined surface is formed, the sheets P stacked on the inclined surface are guided along the inclined surface. As a consequence, the sheets P discharged from the discharge port 192 and having edge portions falling the position of the aforementioned other end of the first sheet sorting member 161A are shifted to a position at which the pivot point 163 of the first sheet sorting member 161A has been provided.

In addition, although not illustrated in the drawing, the aforementioned operation mechanism 170 is also provided to the second sheet sorting members 162A and 162B, similarly to the first sheet sorting members 161A and 161B.

Figure 4:
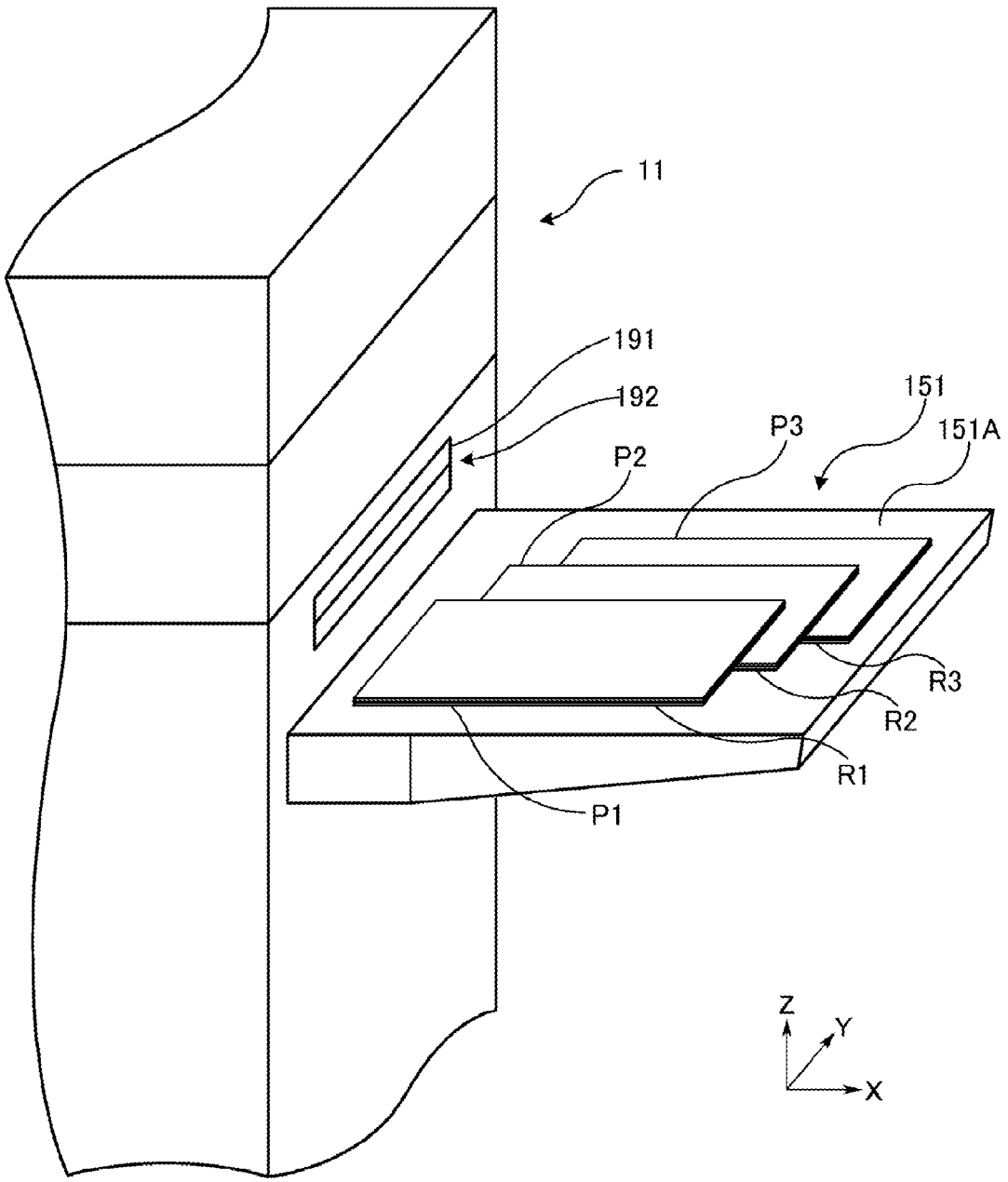
FIG. 4 is a perspective view illustrating sheet bundles stacked on a stacking tray according to an embodiment.

FIG. 4 is a perspective view illustrating sheet bundles stacked on the stacking tray 151. An operation control section 101 (referring to FIG. 6) of the control unit 10 to be described later controls the operation mechanism 170 for operating the sheet sorting members 160. In this way, as illustrated in FIG. 4, the sheets P discharged from the discharge port 192 are shifted in the discharge direction of the sheets P (the X direction of the drawing) and the direction perpendicular to the discharge direction (the Y direction of the drawing), and are sequentially stacked in predetermined areas on the stacking tray 151.

In the example illustrated in FIG. 4, the sheets P discharged from the discharge port 192 are sorted into sheet bundles P1, P2, and P3, and the sheet bundles P1, P2, and P3 are stacked respectively in different areas R1, R2, and R3 on the stacking tray 151. In this case, the area R1 is an area on the stacking tray 151 below the discharge port 192. The sheets P discharged from the discharge port 192 fall into the area R1 and then are stacked on the stacking tray 151.

When the accepting section 102 (referring to FIG. 6) of the control unit 10 to be described later accepts an instruction to stack the sheets P in other areas, the operation mechanism 170 operates under the control of the operation control section 101 of the control unit 10. First, a rising operation of the second sheet sorting member 162A from the stacking surface 151A of the stacking tray 151 and an operation of returning from the rising state are repeated by the operation mechanism 170, so that the sheets P are shifted to the direction perpendicular to the discharge direction (the Y direction of the drawing). Thereafter, a rising operation of the second sheet sorting member 162B from the stacking surface 151A of the stacking tray 151 and an operation of returning from the rising state are repeated by the operation mechanism 170, so that the sheets P are shifted in the discharge direction of the sheets P (the X direction of the drawing). As a consequence, the sheets P in the area R1 on the stacking tray 151 are moved to the area R3 and are stacked in the area R3 as the sheet bundle P3.

Next, when the accepting section 102 of the control unit 10 accepts an instruction to stack sheets P in other areas, the operation mechanism 170 operates again under the control of the operation control section 101 of the control unit 10. In this way, the rising operation of the second sheet sorting member 161A from the stacking surface 151A of the stacking tray 151 and the operation of returning from the rising state are repeated, so that the sheets P are shifted to the direction perpendicular to the discharge direction of the sheets P (the Y direction of the drawing). Thereafter, the rising operation of the second sheet sorting member 161B from the stacking surface 151A of the stacking tray 151 and the operation of returning from the rising state are repeated by the operation mechanism 170, so that the sheets P are shifted in the discharge direction of the sheets P (the X direction of the drawing). As a consequence, the sheets P in the area R1 on the stacking tray 151 are moved to the area R2 and are stacked in the area R2 as the sheet bundle P2. That is, the sheet bundle P2 and the sheet bundle P3 already stacked on the stacking tray 151 are stacked in different areas in the discharge direction of the sheets P (the X direction of the drawing) and the direction perpendicular to the discharge direction (the Y direction of the drawing).

Thereafter, sheets P discharged from the discharge port 192 fall into the area R1 and are stacked in the area R1 as the sheet bundle P1. The sheet bundle P1 and the sheet bundles P2 and P3 already stacked on the stacking tray 151 are stacked in different areas in the discharge direction of the sheets P (the X direction of the drawing) and the direction perpendicular to the discharge direction (the Y direction of the drawing).

Figure 5A:
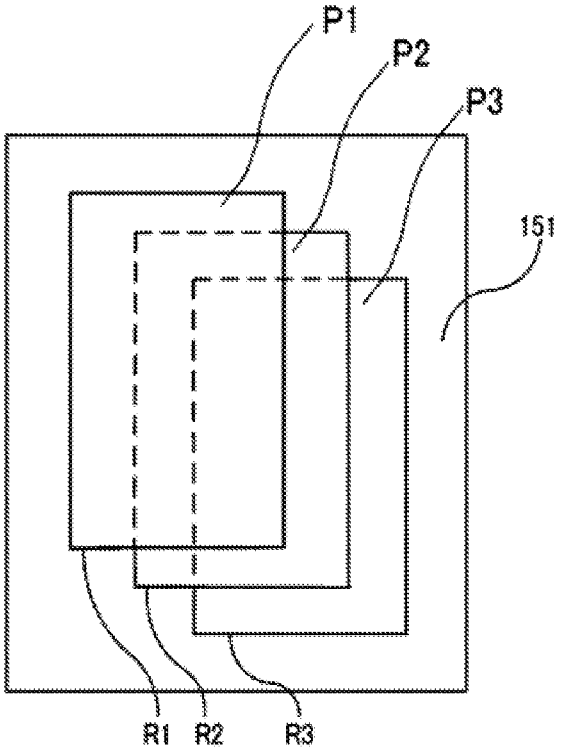
FIG. 5A is a diagram illustrating sheet bundles stacked on a stacking tray according to an embodiment.

As described above, the sheet sorting members 160 are operated by the operation mechanism 170, so that the positions of sheets P on the stacking tray 151 are shifted in the discharge direction of the sheets P (the X direction of the drawing) and the direction perpendicular to the discharge direction (the Y direction of the drawing). As a consequence, since a sheet bundle is stacked in an area different from areas, in which sheet bundles have already stacked on the stacking tray 151, in the discharge direction of sheets P (the X direction of the drawing) and the direction perpendicular to the discharge direction (the Y direction of the drawing), there is an area in which any one of the sheet bundles P1, P2, and P3 stacked on the stacking tray 151 does not overlap other sheet bundles at the end portions of the sheets P, as illustrated in FIG. 5A. Accordingly, it is possible to take out a sheet bundle from the area in which there is no overlap with the other sheet bundles, so that it is easy to take out a desired sheet bundle from a plurality of sheet bundles stacked on the stacking tray 151.

On the other hand, in a general sheet sorting apparatus or image forming apparatus, a stacking tray 251 is moved in a direction perpendicular to a discharge direction of sheets, so that the positions of the sheets on stacking tray 251 are shifted to the direction perpendicular to the discharge direction of the sheets. In this case, in relation to a sheet bundle stacked on the stacking tray 251, the sheets P are sorted into sheet bundles P4, P5, and P6, and the sheet bundles P4, P5, and P6 are stacked in different areas R4, R5, and R6 on the stacking tray 251 as illustrated in FIG. 5B.

Figure 5B:
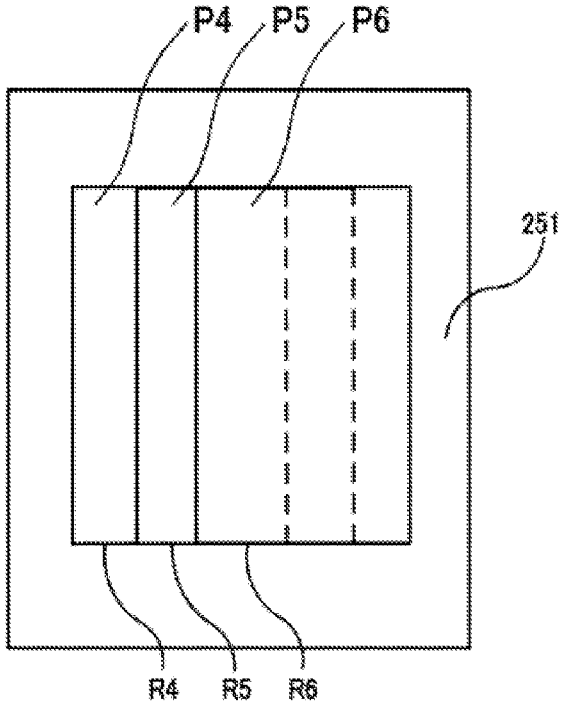
FIG. 5B is a diagram illustrating sheet bundles stacked on a stacking tray in a general image forming apparatus.

In the example illustrated in FIG. 5B, the sheet bundle P4 is first stacked in the area R4 on the stacking tray 251, and then the stacking tray 251 is moved to the direction (the left direction on the sheet) perpendicular to the discharge direction of the sheets, so that the sheet bundle P5 is stacked in the area R5 on the stacking tray 251. Thereafter, the stacking tray 251 is further moved to the direction (the left direction on the sheet) perpendicular to the discharge direction of the sheets, so that the sheet bundle P6 is stacked in the area R6 on the stacking tray 251.

At this time, the sheet bundle P5 is stacked in an area different from the area, in which the sheet bundle P4 has been already stacked on the stacking tray 251, only in the direction perpendicular to the discharge direction of the sheets. Furthermore, the sheet bundle P6 is stacked in an area different from the areas, in which the sheet bundles P4 and P5 have been already stacked on the stacking tray 251, only in the direction perpendicular to the discharge direction of the sheets. Since a sheet bundle is stacked in an area different from areas, in which sheet bundles have been already stacked on the stacking tray 251, in the direction perpendicular to the discharge direction of the sheets, there is an area in which another sheet bundle does not overlap the sheet bundles P4 and P6, among the sheet bundles P4, P5, and P6 stacked on the stacking tray 251, at the end portions of the sheets, but there is no area in which the other sheet bundle does not overlap the sheet bundle P5 at the end portions of the sheets, as illustrated in FIG. 5B. Therefore, it is not easy to take out only the sheet bundle P5 from a plurality of sheet bundles stacked on the stacking tray 251.

Figure 6:
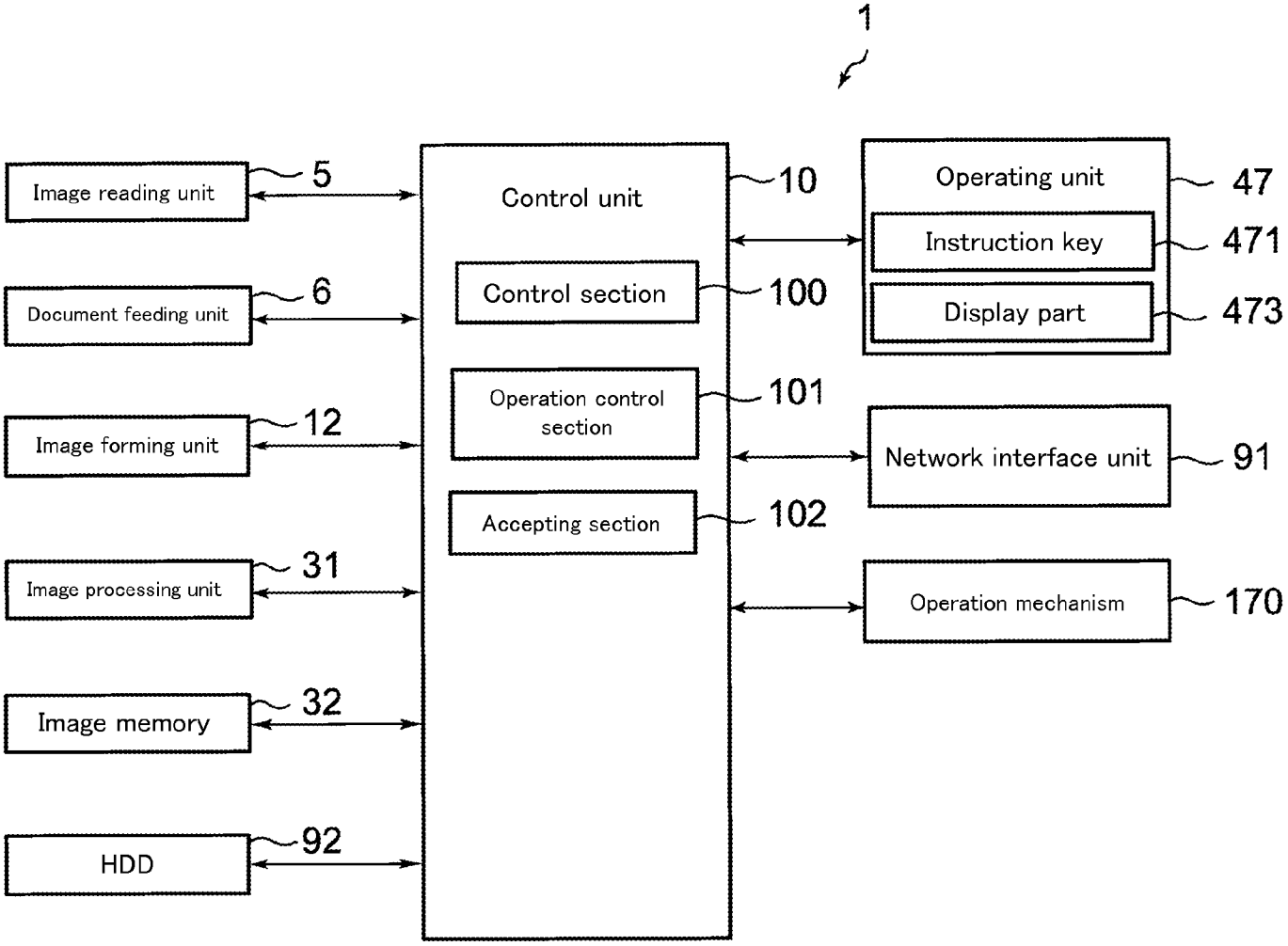
FIG. 6 is a functional block diagram schematically illustrating a main internal configuration of an image forming apparatus according to an embodiment.

Next, an internal configuration of the image forming apparatus 1 will be described. FIG. 6 is a functional block diagram schematically illustrating a main internal configuration of the image forming apparatus 1.

The image forming apparatus 1 includes the image reading unit 5, the document feeding unit 6, the image forming unit 12, an image processing unit 31, an image memory 32, a HDD (Hard Disk Drive) 92, the operating unit 47, a network interface unit 91, the operation mechanism 170, and the like.

The image processing unit 31 performs image processing on image data of an image read by the image reading unit 5 according to necessity. For example, in order to improve quality after an image is formed by the image forming unit 12, the image processing unit 31 performs predetermined image processing such as shading correction on the image read by the image reading unit 5.

The image memory 32 is an area for temporarily storing data of a document image obtained through the reading of the image reading unit 5, or temporarily storing data to be printed by the image forming unit 12.

The HDD (Hard Disk Drive) 92 is a large capacity of storage device for storing image data and the like received from the computer network-connected to the image forming apparatus 1.

The network interface unit 91 includes a communication module such as a LAN board, and performs transmission/reception of various types of data with respect to an apparatus (a personal computer and the like) in a local area via a LAN and the like connected to the network interface unit 91.

The control unit 10 includes a CPU (Central Processing Unit), a RAM, a ROM, and a dedicated hardware circuit and the like. The control unit 10 serves as a control section 100, the operation control section 101, and the accepting section 102 when a program stored in the aforementioned ROM or HDD 92 is executed in the aforementioned CPU.

The control section 100 controls an entire operation of the image forming apparatus 1. The control section 100 is connected to the image reading unit 5, the document feeding unit 6, the image forming unit 12, the image processing unit 31, the image memory 32, the HDD (Hard Disk Drive) 92, the operating unit 47, the network interface unit 91, the operation mechanism 170, and the like. The control section 100 performs operation control of the aforementioned connected each mechanism or transmission/reception of signals or data with respect to each mechanism.

The accepting section 102 has a function of allowing the display part 473 to display a menu screen and accepting an instruction inputted from a user on the basis of the menu screen. In detail, the accepting section 102 accepts an image forming job and accepts an instruction regarding whether to shift sheets P with a formed image in the image forming job on the stacking tray 151 and to stack the sheets P.

Figure 7A:
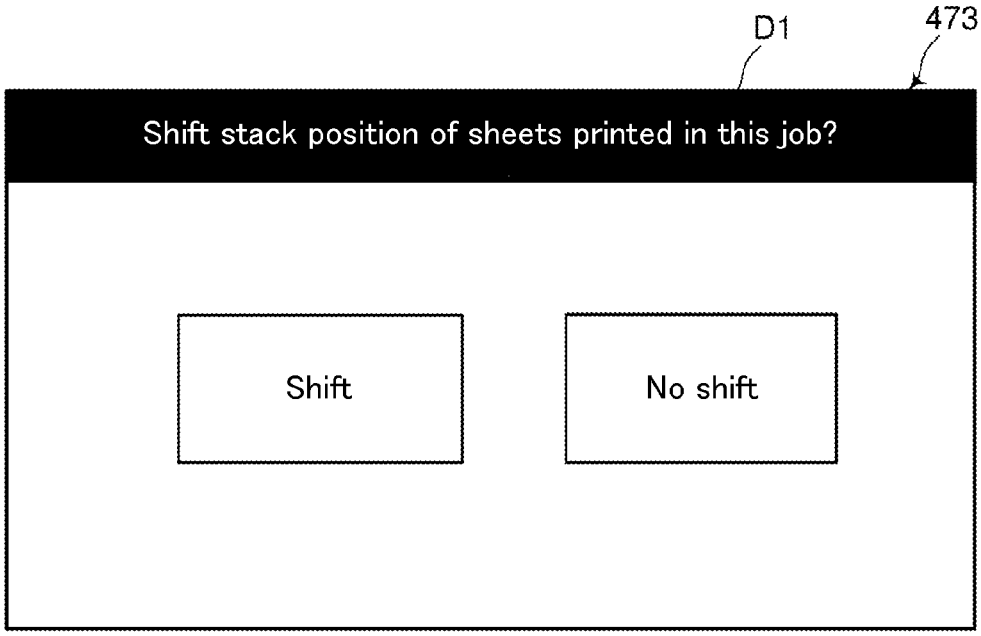
FIG. 7A and FIG. 7B are diagrams illustrating an example of a menu screen displayed on a display part by an accepting section according to an embodiment
Figure 7B:
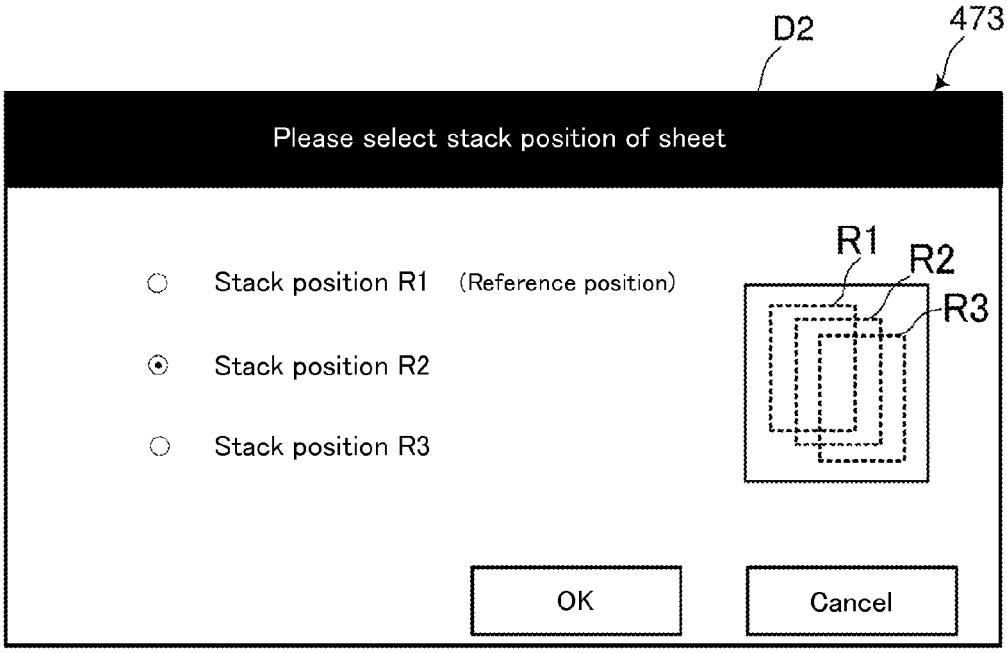

The accepting section 102, for example, allows a menu screen D1 illustrated in FIG. 7A to be displayed on the display part 473. In the case of accepting an instruction to shift and stack sheets P through operation input using the instruction key 471 and the like of the operating unit 47 by a user, the accepting section 102 accepts an area in which the sheets P subjected to image formation are to be stacked. At this time, the accepting section 102, for example, allows a menu screen D2 illustrated in FIG. 7B to be displayed on the display part 473. A plurality of predetermined areas (areas R1, R2, and R3 in the example of FIG. 7B) are provided in the stacking tray 151, and the accepting section 102 accepts an instruction indicating in which area the sheets P subjected to image formation are to be stacked.

In addition, in the above, the case, in which an instruction regarding whether to shift and stack sheets P and an instruction indicating an area in which sheets P subjected to image formation are to be stacked are accepted for each image forming job, has been described; however, the technology of the present disclosure is not necessarily limited to this case. For example, the instruction regarding whether to shift and stack sheets P and the instruction indicating an area in which sheets P subjected to image formation are to be stacked may also be accepted for each sheet P subjected to image formation. In this case, for example, the accepting section 102 accepts an instruction to stack the first sheet to the tenth sheet in the area R1 and stack subsequent sheets after the tenth sheet in the area R2. Furthermore, the instruction regarding whether to shift and stack sheets P and the instruction indicating an area in which sheets P subjected to image formation are to be stacked may also be accepted for each user who uses the image forming apparatus 1. In this case, for example, the accepting section 102 accepts an instruction to stack sheets with an image formed by an image forming job inputted by a user A in the area R1 and sheets with an image formed by an image forming job inputted by a user B in the area R2.

On the basis of the instruction of an area for stacking the sheets P subjected to image formation which has been accepted by the accepting section 102, the operation control section 101 controls the operation mechanism 170 to operate the sheet sorting members 160, thereby shifting the positions of the sheets P on the stacking tray 151 in the discharge direction of the sheets P (the X direction of the drawing) and the direction perpendicular to the discharge direction (the Y direction of the drawing). In this way, it is possible to stack sheets P discharged from the discharge port 192 in areas desired by a user on the stacking tray 151.

As described above, the sheet sorting apparatus according to the present embodiment includes the discharge port 192 through which sheets P are discharged, the stacking tray 151 on which the sheets P discharged from the discharge port 192 are stacked, the sheet sorting member 160 provided on the stacking surface 151A on which the sheets P of the stacking tray 151 are stacked, and the operation mechanism 170 for operating the sheet sorting member 160. The sheet sorting member 160 is provided to be able to rise from the stacking surface 151A by employing one end of the sheet sorting member 160 as the pivot point 163 at a position at which the sheets P fall from the discharge port 192, and rise from the stacking surface 151A by the operation mechanism 170, thereby forming an inclined surface, guiding the sheets P placed on the inclined surface along the inclined surface, and shifting the sheets P stacked on the stacking tray 151 in the discharge direction of the sheets P and the direction perpendicular to the discharge direction.

According to the aforementioned configuration, since a sheet bundle is stacked in an area different from areas, in which sheet bundles have already stacked on the stacking tray 151, in the discharge direction of sheets P and the direction perpendicular to the discharge direction, areas, in which the sheet bundles stacked on the stacking tray 151 do not overlap other sheet bundles at the end portions of the sheets, are ensured. Accordingly, it is possible to take out a sheet bundle from the areas in which there is no overlap with the other sheet bundles, so that it is possible to sort sheets and stack the sheets on the stacking tray 151 such that a user easily takes out the sheets.

Furthermore, in the sheet sorting apparatus according to the present embodiment, the sheet sorting members 160 includes a plurality of sheet sorting members 160 having lengths different from one another from one end as the pivot point 163 to the other end and the plurality of sheet sorting members 160 rise from the stacking surface 151A by the operation mechanism 170, so that sheets P discharged from the discharge port 192 and having edge portions falling at the position of the aforementioned other end are stacked in areas provided for each sheet sorting member 160 on the stacking tray 151.

According to the aforementioned configuration, the sheets P discharged from the discharge port 192 can be stacked in a plurality of predetermined areas on the stacking tray 151.

Furthermore, in the sheet sorting apparatus according to the present embodiment, the rising operation from the stacking surface 151A and the operation of returning from the rising state are repeated to generate swing by the operation mechanism 170, so that the sheets P stacked on the stacking tray 151 are shifted to a position provided with one end as the pivot point 163 of the sheet sorting member 160.

According to the aforementioned configuration, the sheets P discharged from the discharge port 192 can be accurately stacked in the plurality of predetermined areas on the stacking tray 151.

Furthermore, in the sheet sorting apparatus according to the present embodiment, the operation mechanism 170 has the eccentric cams 173 and 176 provided below the sheet sorting member 160 and the eccentric cams 173 and 176 are rotated, so that the sheet sorting member 160 swings when the rising operation from the stacking surface 151A and the operation of returning from the rising state are repeated.

According to the aforementioned configuration, the positions of the sheets P on the stacking tray 151 are shifted in the discharge direction of the sheets P and the direction perpendicular to the discharge direction with a simple configuration, so that it is possible to stack the sheets P on the stacking tray 151.

Embodiment 2

Figure 8:
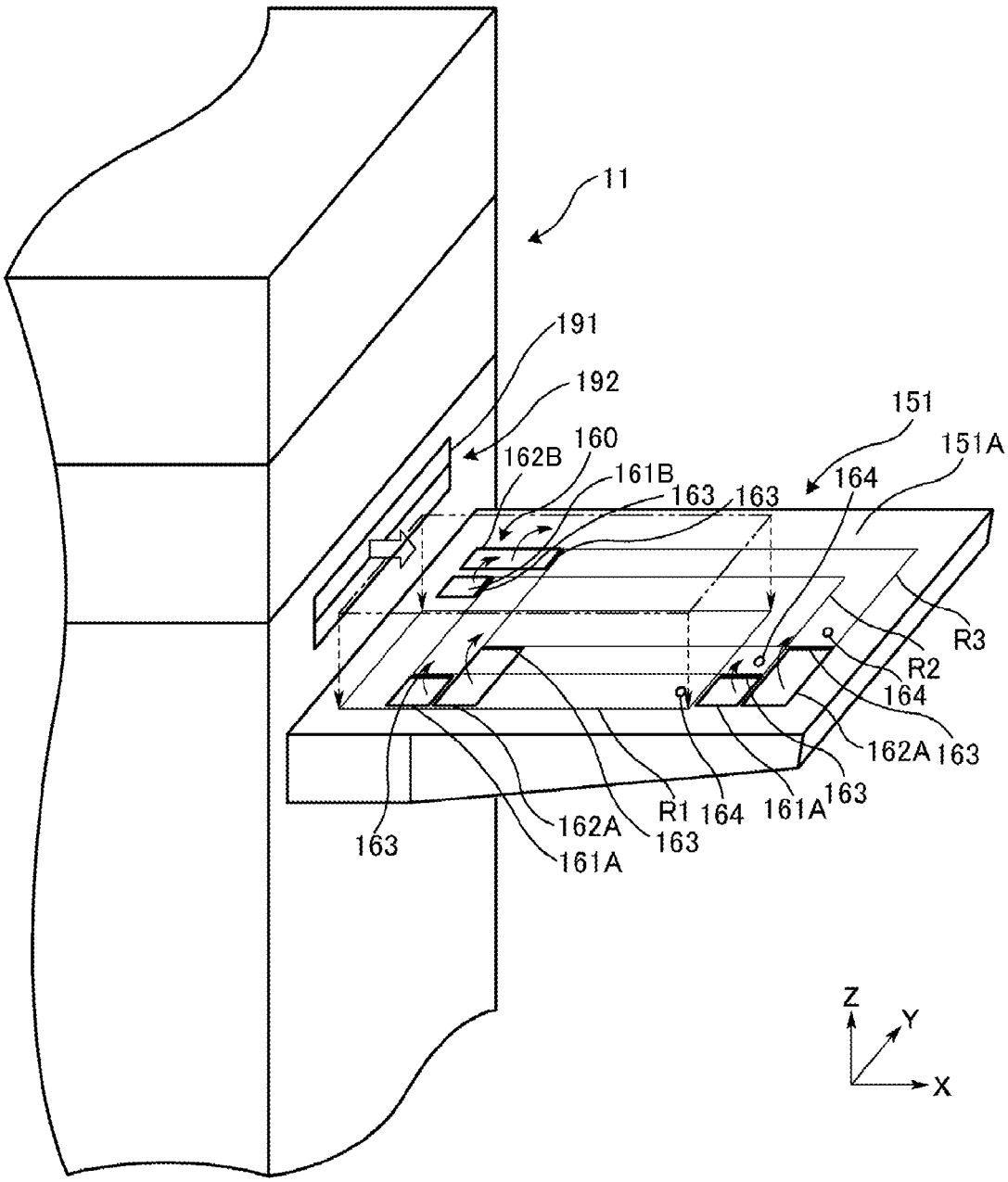
FIG. 8 is a diagram illustrating an embodiment 2 and corresponding to FIG. 2.
Figure 9:
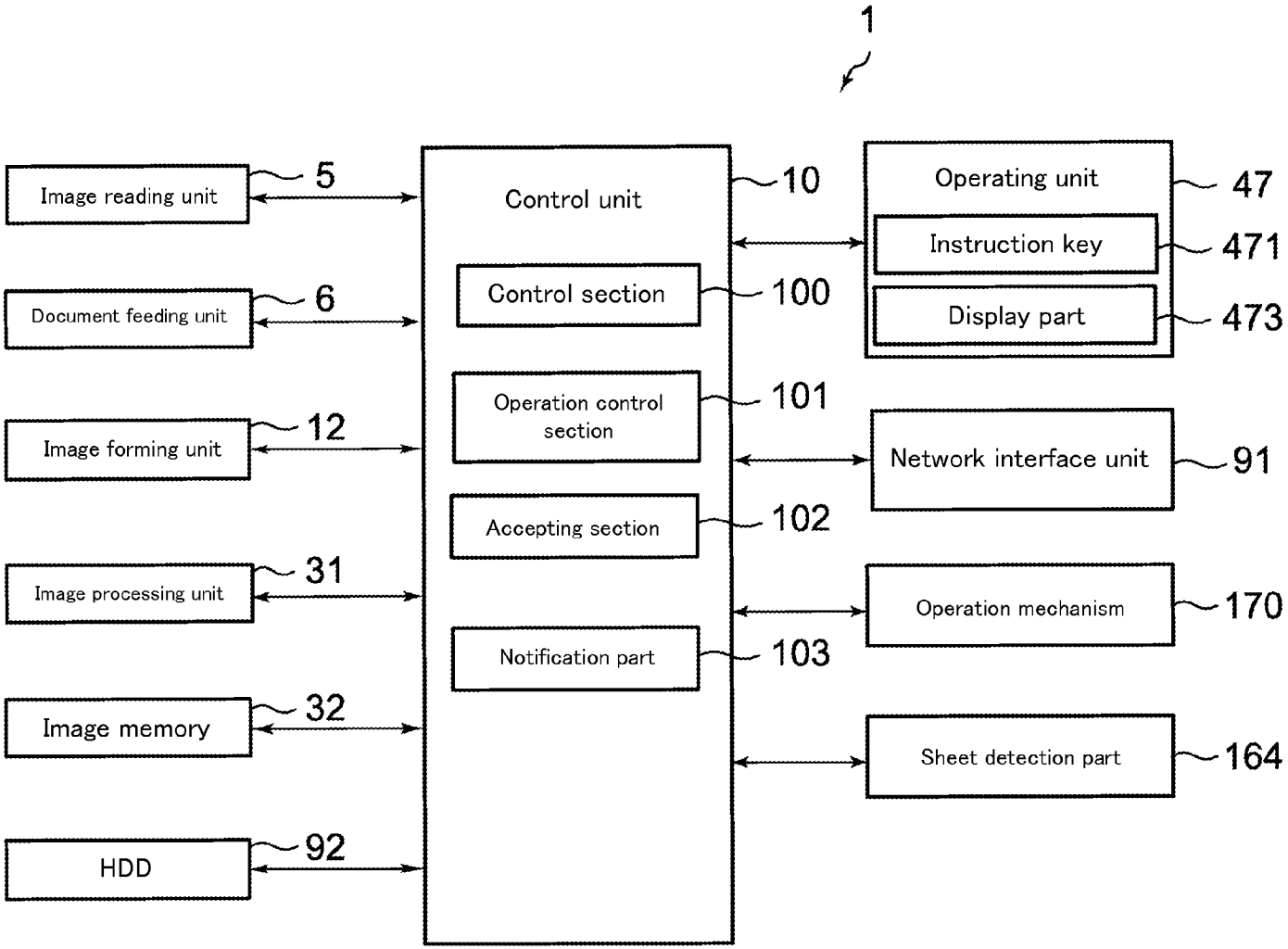
FIG. 9 is a diagram illustrating an embodiment 2 and corresponding to FIG. 6.

FIG. 8 and FIG. 9 illustrate an embodiment 2. The embodiment 2 is different from the embodiment 1 in that the image forming apparatus 1 includes sheet detection parts 164 and a notification part 103. In the following description, the same reference numerals are used to designate the same elements as those of the embodiment 1, and a detailed description thereof will be omitted.

As illustrated in FIG. 8, in the present embodiment, a plurality of sheet detection parts 164 are provided on the stacking surface 151A of the stacking tray 151. The sheet detection parts 164 are provided at end portions which are end portions of predetermined areas (areas R1, R2, and R3 in the example of FIG. 8) on the stacking surface 151A and in which sheets stacked in predetermined areas different from the above predetermined areas do not overlap each other, and detect whether sheets P have been stacked in the predetermined areas. In the example of FIG. 8, three sheet detection parts 164 are provided for respective predetermined areas of the areas R1, R2, and R3, and detect whether sheets P have been stacked in the areas R1, R2, and R3.

The sheet detection part 164, for example, is a reflective sensor and has an infrared light emitting portion and an infrared light receiving portion. When sheets P have been stacked above the sheet detection part 164, since light emitted from the infrared light emitting portion is reflected from the sheets P, the amount of infrared light received in the infrared light receiving portion increases. On the basis of a change in the amount of the infrared light received in the infrared light receiving portion, the sheet detection part 164 detects whether the sheets P have been stacked in the predetermined area. In addition, in the above, the case in which the reflective sensor is employed as the sheet detection part 164 has been described; however, the technology of the present disclosure is not necessarily limited to this case. For example, whether sheets P have been stacked in the predetermined area may also be detected by a contact type sensor.

FIG. 9 is a functional block diagram schematically illustrating a main internal configuration of an image forming apparatus 1 according to the present embodiment. The difference with FIG. 6 of the embodiment 1 is that the image forming apparatus 1 includes the sheet detection parts 164 and the notification part 103, and the others are the same as those of the embodiment 1. In the present embodiment, when the accepting section 102 accepts an instruction to shift sheets P, the operation control section 101 specifies a predetermined area, in which the sheets P have not been stacked, among a plurality of predetermined areas on the stacking surface 151A of the stacking tray 151, on the basis of a detection result by the sheet detection parts 164. Then, the operation control section 101 controls the operation mechanism 170 to operate the sheet sorting members 160, thereby shifting the positions of the sheets P stacked on the stacking tray 151 in the discharge direction of the sheets P (an X direction of the drawing) and a direction perpendicular to the discharge direction (a Y direction of the drawing) and stacking the sheets P in the specified predetermined area in which the sheets P have not been stacked. Since an area in which the sheets P are to be stacked is decided with reference to the detection result of the sheet detection parts 164, there is no risk that the sheets P are newly stacked on an area in which sheets have already been stacked.

Furthermore, when there are a plurality of predetermined areas, in which the sheets P have not been stacked, among the plurality of predetermined areas on the stacking surface 151A of the stacking tray 151, the operation control section 101 allows the sheets P to be stacked in an area remotest from the discharge port 192 among the plurality of predetermined areas.

In the image forming apparatus 1 according to the present embodiment, there are a plurality of sheet sorting members 160 having lengths different from one another from one end as the pivot point 163 to the other end and the plurality of sheet sorting members 160 rise from the stacking surface 151A, so that sheets P are sequentially stacked in a plurality of predetermined areas on the stacking surface 151A. In the case of stacking the sheets P by using the aforementioned mechanism, it is preferable that the sheets P are stacked from the remotest area from the position at which the sheets P have fallen on the stacking tray 151. This is because when the sheets P are stacked in an area near the position at which the sheets P have fallen on the stacking tray 151, it is not possible to stack subsequently discharged sheets P in an area remoter from the position, at which the sheets P have fallen on the stacking tray 151, as compared with the near area.

The aforementioned content will be described in detail by using the example illustrated in FIG. 8. Hereinafter, it is considered the case in which sheets P have been already stacked in the area R2. For example, when sheets P are stacked in the area R3, in order to shift sheets P discharged from the discharge port 192 and fallen in the area R1, it is necessary to raise the second sheet sorting members 162A and 162B. However, the case in which the sheets P have been already stacked in the area R2, when the second sheet sorting members 162A and 162B rise, the sheets P stacked in the area R2 are shifted by the second sheet sorting members 162A and 162B as well as the sheets P fallen in the area R1, so that the sheets P are stacked in the area R3. As described above, when the sheets P have been stacked in the area R2, even though sheets P have not been stacked in the area R3, it is not possible to newly stack sheets P in the area R3.

On the other hand, in the image forming apparatus 1 according to the present embodiment, when there are a plurality of predetermined areas, in which sheets P have not been stacked, among the plurality of predetermined areas on the stacking surface 151A of the stacking tray 151, the operation control section 101 allows sheets P to be stacked in an area remotest from the position, at which the sheets P have fallen on the stacking tray 151, among the plurality of predetermined areas. In this way, it is possible to stack the sheets P in more areas by the stacking surface 151A of the stacking tray 151.

Furthermore, in the case in which sheets P stacked in the predetermined area on the stacking tray 151 have not been detected by the sheet detection part 164 due to taking-out and the like of the sheets P from the stacking tray 151, when the sheet detection part 164 detects that sheets P have been stacked in the area closer to the position at which the sheets P have fallen on the stacking tray 151 as compared with the aforementioned area, the operation control section 101 controls the operation mechanism 170 such that the sheet sorting members 160 shift the sheets P, which have been stacked in the area near the position at which the sheets P have fallen on the stacking tray 151, to the area in which the sheets P have not been detected. In this way, in the case of the taking-out and the like of the sheets P from the stacking tray 151 by a user, it is possible to increase an area in which sheets P can be stacked on the stacking tray 151.

The notification part 103 has a function of allowing the display part 473 to display a notification screen indicating an area in which sheets P have been stacked and an area in which sheets P have not been stacked among the plurality of predetermined areas on the stacking tray 151, on the basis of the detection result by the sheet detection parts 164. In this way, it is possible to specify the area on the stacking tray 151 in which sheets P have not been stacked.

As described above, the sheet sorting apparatus according to the present embodiment includes the discharge port 192 through which sheets P are discharged, the stacking tray 151 on which the sheets P discharged from the discharge port 192 are stacked, the sheet sorting members 160 and the operation mechanism 170, the operation control section 101 for controlling the sheet sorting members 160 and the operation mechanism 170, and the sheet detection parts 164. The sheet sorting members 160 and the operation mechanism 170 shift the positions of sheets P on the stacking tray 151 in the discharge direction of the sheets P and the direction perpendicular to the discharge direction, thereby sequentially stacking the sheets P in the plurality of predetermined areas on the stacking tray 151. Furthermore, the sheet detection parts 164 are provided at end portions which are end portions of the predetermined areas on the stacking tray 151 and in which sheets stacked in predetermined areas different from the above predetermined areas do not overlap each other, and detect whether sheets have been stacked in the above predetermined areas.

According to the aforementioned configuration, since a sheet bundle is stacked in an area different from areas, in which sheet bundles have already stacked on the stacking tray 151, in the discharge direction of sheets P and the direction perpendicular to the discharge direction, areas, in which the sheet bundles stacked on the stacking tray 151 do not overlap other sheet bundles, are ensured. Accordingly, it is possible to take out a sheet bundle from the areas in which there is no overlap with the other sheet bundles, so that it is possible to sort sheets and stack the sheets on the stacking tray 151 such that a user easily takes out the sheets. Furthermore, since an area in which sheets P are to be stacked is decided with reference to the detection result of the sheet detection parts 164, there is no risk that the sheets P are newly stacked on an area in which sheets have already been stacked.

Embodiment 3

Figure 10:
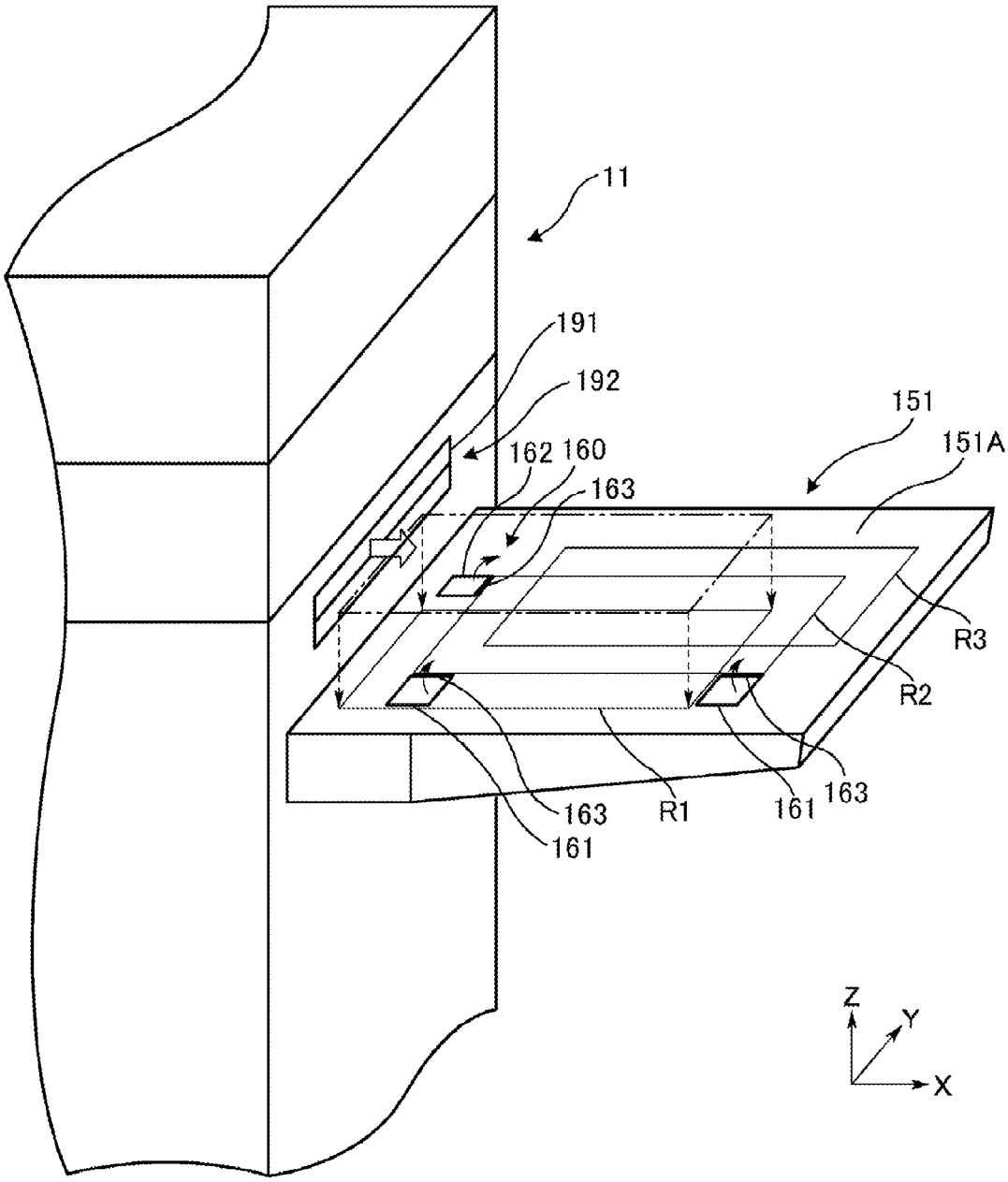
FIG. 10 is a diagram illustrating an embodiment 3 and corresponding to FIG. 2.
Figure 11:
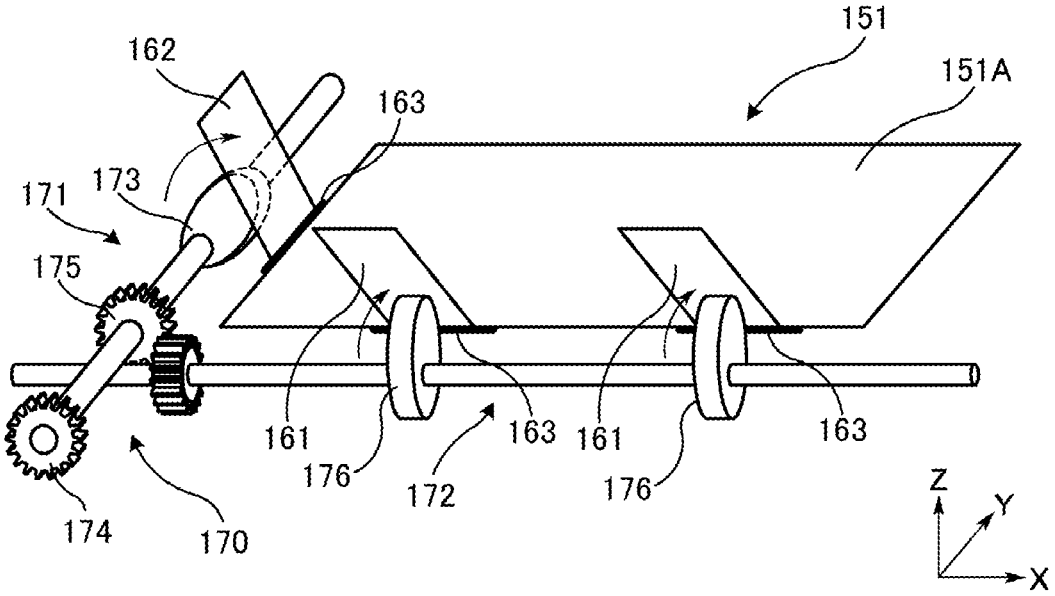
FIG. 11 is a diagram illustrating an embodiment 3 and corresponding to FIG. 3.

FIG. 10 and FIG. 11 illustrate an embodiment 3. The embodiment 3 is different from the aforementioned each embodiment in that forces applied to sheets P are made different by an inclined surface formed when the sheet sorting member 160 rises, so that the sheets P are sorted. In the following description, the same reference numerals are used to designate the same elements as those of the embodiment 1, and a detailed description thereof will be omitted.

Referring to FIG. 10, the sheet sorting member 160 has first sheet sorting members 161 and a second sheet sorting member 162. Two first sheet sorting members 161 are provided at end portions of a direction perpendicular to the discharge direction of sheets P (a Y direction of the drawing) on the stacking surface 151A of the stacking tray 151. Furthermore, the first sheet sorting members 161 can rise in the direction perpendicular to the discharge direction of the sheets P (the Y direction of the drawing).

Furthermore, one second sheet sorting member 162 is provided at an end portion of the discharge direction of the sheets P (the X direction of the drawing) on the stacking surface 151A of the stacking tray 151. Furthermore, the second sheet sorting member 162 can rise in the discharge direction of the sheets P (the X direction of the drawing). In addition, in FIG. 10, one end of each of the first sheet sorting member and the second sheet sorting member 162 is positioned on the outer periphery of an area in which the sheets P on the stacking tray 151 are stacked. However, the technology of the present disclosure is not necessarily limited to this case. One end of each of the first sheet sorting member 161 and the second sheet sorting member 162 may also be positioned outward from the outer periphery of the area in which the sheets P on the stacking tray 151 are stacked. In this way, it is possible to more accurately shift the sheets P in the discharge direction of the sheets P and the direction perpendicular to the discharge direction.

FIG. 11 is a schematic view illustrating the structure of the operation mechanism 170 for operating the sheet sorting member 160. As illustrated in FIG. 11, the stacking tray 151 is provided therein with the operation mechanism 170 for operating the sheet sorting member 160. The operation mechanism 170 has the first cam shaft 171 extending in the direction perpendicular to the discharge direction of sheets P (the Y direction of the drawing), and the second cam shaft 172 extending in the discharge direction of the sheets P (the X direction of the drawing). The first cam shaft 171 receives a driving force supplied from a motor (not illustrated) via the driving force supply gear 174. Below the second sheet sorting member 162, the eccentric cam 173 of the first cam shaft 171 is provided. The eccentric cam 173 is rotated by the driving force supplied to the first cam shaft 171, so that a force acts in a vertical direction with respect to the second sheet sorting member 162. In this way, the second sheet sorting member 162 rises from the stacking surface 151A of the stacking tray 151. When the second sheet sorting member 162 rises from the stacking surface 151A of the stacking tray 151, an inclined surface is formed, so that a force is applied to the sheets P stacked on the stacking tray 151 by the inclined surface in the discharge direction of the sheets P (the X direction of the drawing). By changing the rotation speed of the eccentric cam 173, it is possible to change the speed at which the second sheet sorting member 162 rises from the stacking surface 151A. That is, by changing the rotation speed of the eccentric cam 173, it is possible to change the size of the force applied to the sheets P, so that the operation mechanism 170 can shift the sheets P stacked on the stacking tray 151 to an arbitrary position of the discharge direction of the sheets P (the X direction of the drawing).

The first cam shaft 171 is provided with the driving force distribution gear 175 for distributing the driving force supplied from the motor (not illustrated) via the driving force supply gear 174 to the second cam shaft 172. The driving force supplied from the motor (not illustrated) is distributed to the second cam shaft 172 by the driving force distribution gear 175. Below the first sheet sorting member 161, the eccentric cam 176 of the second cam shaft 172 is provided. The eccentric cam 176 is rotated by the driving force distributed to the second cam shaft 172, so that a force acts in a vertical direction with respect to the first sheet sorting member 161. In this way, the first sheet sorting member 161 rises from the stacking surface 151A of the stacking tray 151. When the first sheet sorting member 161 rises from the stacking surface 151A of the stacking tray 151, an inclined surface is formed, so that a force is applied to the sheet P stacked on the stacking tray 151 by the inclined surface in the direction perpendicular to the discharge direction of the sheets P (the Y direction of the drawing). By changing the rotation speed of the eccentric cam 176, it is possible to change the speed at which the first sheet sorting member 161 rises from the stacking surface 151A. That is, by changing the rotation speed of the eccentric cam 176, it is possible to change the size of the force applied to the sheets P, so that the operation mechanism 170 can shift the sheet P stacked on the stacking tray 151 to an arbitrary position of the direction perpendicular to the discharge direction of the sheets P (the Y direction of the drawing).

The operation control section 101 of the control unit 10 controls the operation mechanism 170 for operating the sheet sorting member 160. The speeds for rotating the eccentric cams 173 and 176 are preset for each area in which sheets P are to be moved, and the operation mechanism 170 rotates the eccentric cams 173 and 176 at the preset speeds under the control of the operation control section 101. That is, the operation mechanism 170 allows forces applied to the sheets P from the first sheet sorting member 161 and the second sheet sorting member 162 to be different from each other, thereby moving the sheets P to an area selected from among a plurality of predetermined areas on the stacking tray 151.

As illustrated in FIG. 4, sheets P discharged from the discharge port 192 are sorted into sheet bundles P1, P2, and P3, and the sheet bundles P1, P2, and P3 are stacked in different areas R1, R2, and R3 on the stacking tray 151. In this case, the area R1 is an area on the stacking tray 151 below the discharge port 192. The sheets P discharged from the discharge port 192 fall into the area R1 and then are stacked on the stacking tray 151.

When the accepting section 102 of the control unit 10 accepts an instruction to stack sheets P in other areas, the operation mechanism 170 operates under the control of the operation control section 101 of the control unit 10. The operation mechanism 170 rotates the eccentric cams 173 and 176 at predetermined speeds, so that the first sheet sorting member 161 and the second sheet sorting member 162 rise from the stacking surface 151A. As a consequence, the sheets P positioned in the area R1 on the stacking tray 151 are shifted to the area R3 and are stacked in the area R3 as the sheet bundle P3.

Next, when the accepting section 102 of the control unit accepts an instruction to stack sheets P in other areas, the operation mechanism 170 operates again under the control of the operation control section 101 of the control unit 10. The operation mechanism 170 rotates the eccentric cams 173 and 176 at the predetermined speeds, so that the first sheet sorting member 161 and the second sheet sorting member 162 rise from the stacking surface 151A. In this case, the rotation speeds of the eccentric cams 173 and 176 are slower than those of the eccentric cams 173 and 176 when the sheets P have been shifted to the area R3. As a consequence, the sheets P positioned in the area R1 on the stacking tray 151 are moved to the area R2 and are stacked in the area R2 as the sheet bundle P2. That is, the sheet bundle P2 and the sheet bundle P3 already stacked on the stacking tray 151 are stacked in different areas in the discharge direction of the sheets P (the X direction of the drawing) and the direction perpendicular to the discharge direction (the Y direction of the drawing).

Thereafter, sheets P discharged from the discharge port 192 fall into the area R1 and are stacked in the area R1 as the sheet bundle P1. The sheet bundle P1, and the sheet bundles P2 and P3 already stacked on the stacking tray 151 are stacked in different areas in the discharge direction of the sheets P (the X direction of the drawing) and the direction perpendicular to the discharge direction (the Y direction of the drawing).

As described above, the sheet sorting apparatus according to the present embodiment includes the discharge port 192 through which sheets P are discharged, the stacking tray 151 on which the sheets P discharged from the discharge port 192 are stacked, the first sheet sorting member 161 and the second sheet sorting member 162 provided on the stacking surface 151A on which the sheets P of the stacking tray 151 are stacked, and the operation mechanism 170 for operating the first sheet sorting member 161 and the second sheet sorting member 162. The second sheet sorting member 162 applies a force to sheets P stacked on the stacking tray 151 in the discharge direction of the sheets P, thereby shifting the sheets P in the discharge direction. The first sheet sorting member 161 applies a force to sheets P stacked on the stacking tray 151 in the direction perpendicular to the discharge direction, thereby shifting the sheets P in the direction perpendicular to the discharge direction. The operation mechanism 170 allows the forces applied to the sheets P from the first sheet sorting member 161 and the second sheet sorting member 162 to be different from each other, thereby moving the sheets P to an area selected from among a plurality of predetermined areas on the stacking tray 151.

According to the aforementioned configuration, since a sheet bundle is stacked in an area different from areas, in which sheet bundles have already stacked on the stacking tray 151, in the discharge direction of sheets P and the direction perpendicular to the discharge direction, areas, in which the sheet bundles stacked on the stacking tray 151 do not overlap other sheet bundles at the end portions of the sheets, are ensured. Accordingly, it is possible to take out a sheet bundle from the areas in which there is no overlap with the other sheet bundles, so that it is possible to sort sheets and stack the sheets on the stacking tray 151 such that a user easily takes out the sheets.

Furthermore, in the sheet sorting apparatus according to the present embodiment, each of the first sheet sorting member 161 and the second sheet sorting member 162 is provided to be able to rise from the stacking surface 151A by employing one end thereof as the pivot point 163 and is operated by the operation mechanism 170 to rise from the stacking surface 151A, thereby forming an inclined surface and applying a force to sheets P by the inclined surface.

According to the aforementioned configuration, the force applied to the sheets P is changed with a simple configuration, so that it is possible to selectively move the sheets P in a plurality of predetermined areas on the stacking tray 151.

Furthermore, in the sheet sorting apparatus according to the present embodiment, the operation mechanism 170 changes speeds at which the first sheet sorting member 161 and the second sheet sorting member 162 rise from the stacking surface 151A, thereby changing forces applied to sheets P from the first sheet sorting member 161 and the second sheet sorting member 162. Furthermore, in the sheet sorting apparatus according to the present embodiment, the operation mechanism 170 has the eccentric cams 173 and 176 provided below the first sheet sorting member 161 and the second sheet sorting member 162. Furthermore, the operation mechanism 170 changes the rotation speeds of the eccentric cams 173 and 176, thereby changing the speeds at which the first sheet sorting member 161 and the second sheet sorting member 162 rise from the stacking surface 151A.

According to the aforementioned configuration, the speeds at which the first sheet sorting member 161 and the second sheet sorting member 162 rise from the stacking surface 151A are changed with a simple configuration, so that it is possible to change forces applied to sheets P.

Modification 1

In addition to the stacking tray 151 described in the aforementioned each embodiment, the image forming apparatus 1 includes a stacking tray 180 as a discharge destination to which sheets P subjected to image formation are discharged (referring to FIG. 1). On the stacking tray 180, the sheets P subjected to image formation, which are discharged from a discharge port 182 by a discharge roller 181, are stacked. The sheet sorting apparatus described in the aforementioned embodiments may also be provided to the stacking tray 180.

Modification 2

In the aforementioned each embodiment, the case, in which the first cam shaft 171 and the second cam shaft 172 operate to allow forces to act in the vertical direction with respect to the sheet sorting members 160, thereby swing the sheet sorting members 160, has been described; however, the technology of the present disclosure is not necessarily limited to this case. By using another mechanism, forces may act in the vertical direction with respect to the sheet sorting members 160, so that the sheet sorting members 160 may swing.

Modification 3

Figure 12:
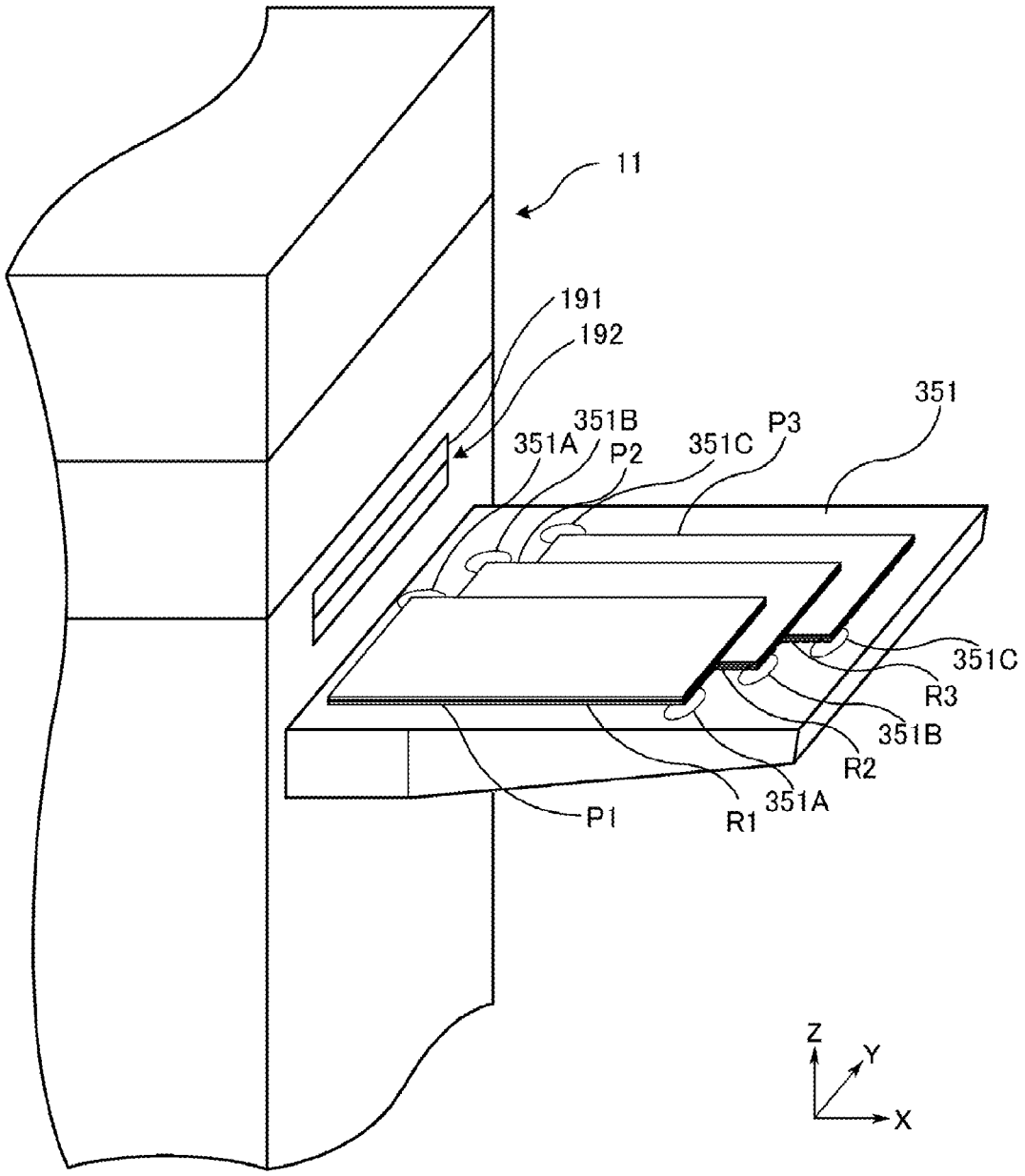
FIG. 12 is a perspective view illustrating a stacking tray in an image forming apparatus according to a modification of each embodiment.

The stacking tray described in the aforementioned each embodiment may be formed with concave portions for guiding the tacking-out of sheets. FIG. 12 is a perspective view illustrating a stacking tray 351 in an image forming apparatus according to the modification 3. In predetermined areas R1, R2, and R3 on the stacking tray 351, sheet bundles P1, P2, and P3 are respectively stacked. At end portions of the predetermined areas R1, R2, and R3, in which sheet bundles stacked in predetermined areas different from the above predetermined areas do not overlap each other, concave portions 351A, 351B, and 351C for guiding the tacking-out of sheets are provided. Since the concave portions 351A, 351B, and 351C for guiding the tacking-out of sheets are provided in areas in which other sheet bundles do not overlap each other at end portions of sheets P, it is easy to grasp the areas in which the other sheet bundles do not overlap each other. As a consequence, it is possible to sort sheets and stack the sheets on the stacking tray 151 such that a user easily takes out the sheets.

Modification 4

Figure 13:
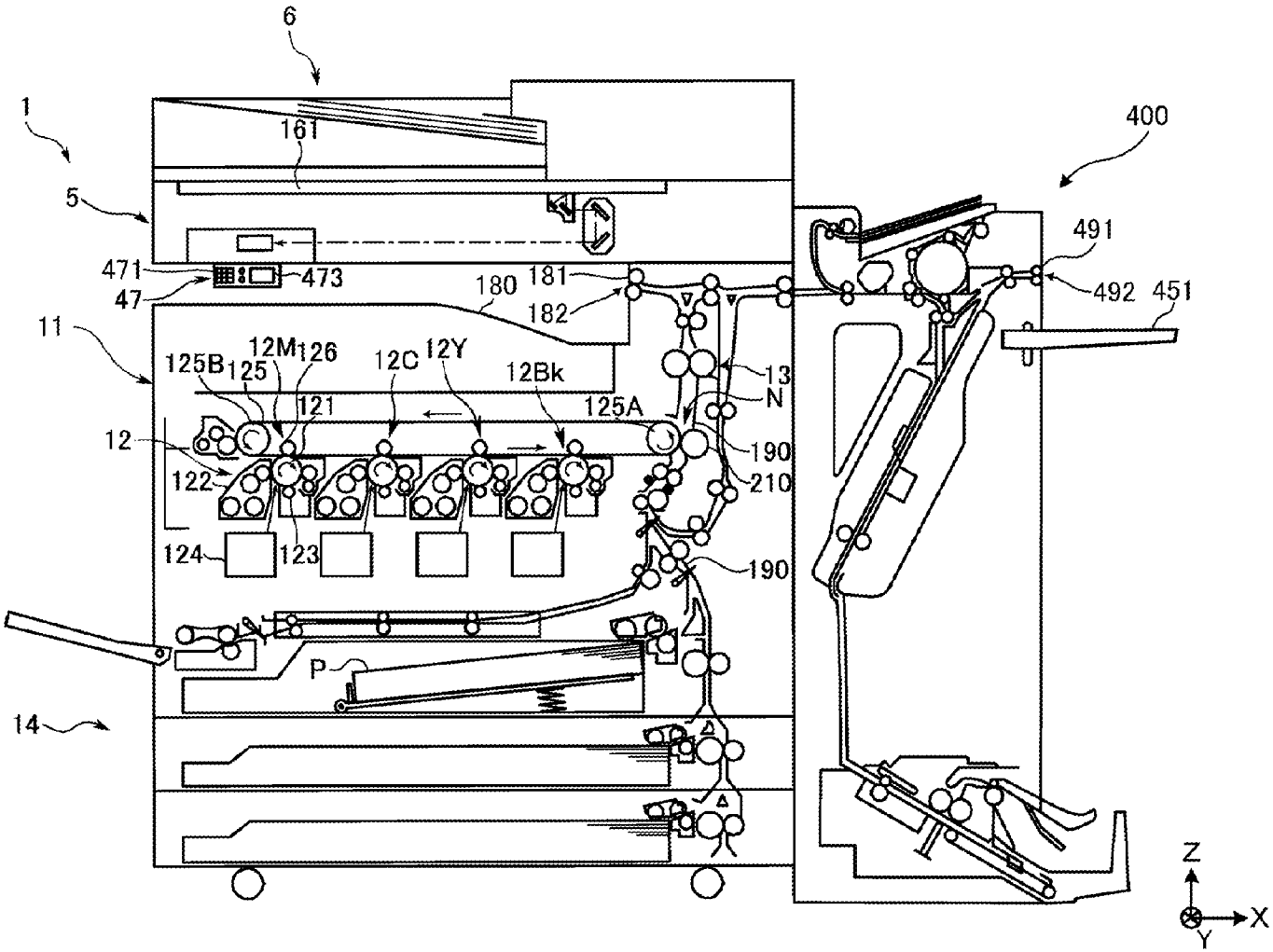
FIG. 13 is a front sectional view illustrating the structure of a post-processing apparatus provided with a sheet sorting apparatus according to a modification of each embodiment.

The sheet sorting apparatus described in the aforementioned each embodiment may also be provided to a post-processing apparatus that performs post-processing such as stapling processing, punch processing, and folding processing on a sheet with an image formed in an image forming apparatus. FIG. 13 is a front sectional view illustrating the structure of a post-processing apparatus 400 provided with the sheet sorting apparatus according to the modification 4.

A sheet P with an image formed in the image forming apparatus 1 is subjected to post-processing such as stapling processing, punch processing, and folding processing in the post-processing apparatus 400, and then is discharged from a discharge port 492 by a discharge roller 491. The sheet P discharged from the discharge port is stacked on a stacking tray 451 provided below the discharge port 492. Similarly to the aforementioned embodiment, the stacking tray 451 is provided with a plurality of sheet sorting members provided on a stacking surface on which the sheet P is stacked, and an operation mechanism for operating the sheet sorting members. The sheet sorting members are operated by the operation mechanism, so that the position of the sheet P on the stacking tray 451 is shifted in the discharge direction of the sheet P and a direction perpendicular to the discharge direction.

In addition, the technology of the present disclosure is not limited to the configuration of the aforementioned each embodiment and various modifications can be made. For example, the aforementioned embodiments have been described using a multifunction peripheral as one embodiment of the image forming apparatus according to the present disclosure. However, this is for illustrative purposes only, and other electronic appliances, for example, other image forming apparatuses such as printers, copy machines, and facsimiles may also be employed.

Furthermore, the technology of the present disclosure includes an arbitrary combination of the aforementioned each embodiment and each modification.

What is claimed is:

1. A sheet sorting apparatus comprising:

a discharge port through which sheets are discharged;

a stacking tray on which the sheets discharged from the discharge port are stacked;

a sheet sorting member provided on a stacking surface on which the sheets of the stacking tray are stacked; and an operation mechanism for operating the sheet sorting member, wherein the sheet sorting member is provided to be able to rise from the stacking surface by employing one end of the sheet sorting member as a pivot point, at a position at which the sheets fall from the discharge port, and rises from the stacking surface by the operation mechanism, thereby forming an inclined surface, guiding the sheets placed on the inclined surface along the inclined surface, and shifting the sheets stacked on the stacking tray in a discharge direction of the sheets and a direction perpendicular to the discharge direction.

2. The sheet sorting apparatus of claim 1, wherein the sheet sorting member is configured to guide the sheets falling from the discharge port along the inclined surface and to shift the sheets in the discharge direction of the sheets and the direction perpendicular to the discharge direction, and a plurality of sheet sorting members having different lengths from the one end as the pivot point to the other end are provided to the sheet sorting member and rise from the stacking surface by the operation mechanism, thereby allowing the sheets discharged from the discharge port and having edge portions falling at a position of the other end to be stacked in a predetermined area provided for each sheet sorting member on the stacking tray.

3. The sheet sorting apparatus of claim 1, wherein the sheet sorting member swings when a rising operation from the stacking surface and an operation of returning from a rising state are repeated by the operation mechanism, so that the sheets stacked on the stacking tray are shifted to a position provided with the one end as the pivot point of the sheet sorting member.

4. The sheet sorting apparatus of claim 3, wherein the operation mechanism has an eccentric cam provided below the sheet sorting member, and the eccentric cam is rotated, thereby swing the sheet sorting member when the rising operation from the stacking surface and the operation of returning from the rising state are repeated.

5. The sheet sorting apparatus of claim 1, wherein a concave portion for guiding taking-out of the sheets is formed at an end portion of a predetermined area on the stacking tray provided for each sheet sorting member, and in the end portion, sheets stacked in other areas do not overlap each other.

6. The sheet sorting apparatus of claim 1, further comprising:

an accepting section that accepts an instruction regarding whether to shift positions of the sheets on the stacking tray in the discharge direction of the sheets and the direction perpendicular to the discharge direction, wherein, when the instruction to shift the positions of the sheets is accepted by the accepting section, the operation mechanism operates the sheet sorting member to shift the sheets in the discharge direction of the sheets and the direction perpendicular to the discharge direction.

7. The sheet sorting apparatus of claim 1, wherein the sheet sorting member is configured to guide the sheets falling from the discharge port along the inclined surface and to shift the sheets in the discharge direction of the sheets and the direction perpendicular to the discharge direction, and comprises:

a control unit that controls the operation mechanism; and a sheet detection part provided at an end portion which is an end portion of a predetermined area on the stacking tray for each sheet sorting member and in which sheets stacked in predetermined areas on the stacking tray different from the predetermined area do not overlap each other, and detecting whether sheets have been stacked in the predetermined area.

8. The sheet sorting apparatus of claim 7, further comprising:

an accepting section that accepts an instruction regarding whether to shift positions of the sheets on the stacking tray in the discharge direction of the sheets and the direction perpendicular to the discharge direction, wherein, when the instruction to shift the positions of the sheets is accepted by the accepting section, the control unit controls the operation mechanism such that the sheets are stacked in the predetermined area in which stacking of sheets is not detected by the sheet detection part.

9. The sheet sorting apparatus of claim 7, further comprising:

a notification part that notifies a user of an area in which the sheets have been stacked and an area in which the sheets have not been stacked among a plurality of predetermined areas for each sheet sorting member, on the basis of a detection result by the sheet detection part.

10. The sheet sorting apparatus of claim 7, wherein the sheet sorting member is provided to be able to rise from the stacking surface by employing one end of the sheet sorting member as the pivot point at the position at which the sheets fall from the discharge port, includes a plurality of sheet sorting members having different lengths from the one end as the pivot point to the other end, and rises from the stacking surface by the operation mechanism, thereby forming an inclined surface, guiding the sheets placed on the inclined surface along the inclined surface, and shifting the sheets stacked on the stacking tray in the discharge direction of the sheets and the direction perpendicular to the discharge direction, and stacking the sheets in a plurality of predetermined areas on the stacking tray.

11. The sheet sorting apparatus of claim 7, wherein, when a plurality of predetermined areas, in which the sheets have not been stacked, are detected by the sheet detection part, the control unit controls the sheet sorting member to stack the sheets in an area remotest from the position at which the sheets have fallen on the stacking tray among the plurality of predetermined areas in which the sheets have not been stacked.

12. The sheet sorting apparatus of claim 7, wherein, in a case in which the sheets stacked in the predetermined area have not been detected by the sheet detection part, when the sheet detection part detects that sheets have been stacked in an area closer to the position, at which the sheets have fallen on the stacking tray, as compared with the predetermined area, the control unit controls the sheet sorting member to shift the sheets stacked in the area near the position, at which the sheets have fallen on the stacking tray, to the area in which the sheets have not been detected.

13. The sheet sorting apparatus of claim 7, wherein a concave portion for guiding taking-out of the sheets is formed at an end portion of the predetermined area on the stacking tray, and in the end portion, sheets stacked in a predetermined area different from the predetermined area do not overlap each other.

* * * * *